United States Patent [19]

Dalebout et al.

[11] Patent Number: 5,000,443

[45] Date of Patent: Mar. 19, 1991

[54] STRIDING EXERCISER

[75] Inventors: William T. Dalebout; Curt G. Bingham, both of Logan, Utah

[73] Assignee: Weslo, Inc., Logan, Utah

[21] Appl. No.: 303,943

[22] Filed: Jan. 30, 1989

Related U.S. Application Data

[63] Continuation-in-part of Ser. No. 93,778, Sep. 8, 1987, Pat. No. 4,850,585.

[51] Int. Cl.[5] ..... A63B 22/02

[52] U.S. Cl. ..... 272/70; 272/131

[58] Field of Search ..... 272/70, 71, 72, 97, 272/120, 125, 126, 130, 131, 132, 134; 128/25 R

[56] References Cited

U.S. PATENT DOCUMENTS

| | | | |
|---|---|---|---|
| 3,580,569 | 5/1971 | Wilson . | |
| 3,747,924 | 7/1973 | Champoox | 272/70 X |
| 3,756,969 | 9/1973 | Hague . | |
| 3,784,194 | 1/1974 | Perrine . | |
| 3,970,302 | 7/1976 | McFee | 272/130 |
| 4,226,415 | 10/1980 | Wright . | |
| 4,456,247 | 6/1984 | Ehrenfried . | |
| 4,478,411 | 10/1984 | Baldwin . | |
| 4,529,194 | 7/1985 | Haaheim . | |
| 4,550,908 | 11/1985 | Dixon . | |
| 4,566,693 | 1/1986 | Seidentop . | |
| 4,600,187 | 7/1986 | Schenker | 272/70 |
| 4,645,200 | 2/1987 | Hix | 272/126 X |

FOREIGN PATENT DOCUMENTS

| | | | |
|---|---|---|---|
| 2416778 | 10/1974 | Fed. Rep. of Germany | 272/70 |
| 3209353 | 9/1983 | Fed. Rep. of Germany | 272/120 |

*Primary Examiner*—Robert W. Bahr

*Attorney, Agent, or Firm*—Trask, Britt & Rossa

[57] ABSTRACT

An exercise apparatus for performing striding-type exercises is disclosed. The apparatus includes a pair of leg members depended from and rotatably associated with a pair of journals connected to a frame. Each of the leg members is fitted with a foot support. The leg members are mechanically associated one with another by a cable and pulley arrangement adapted for providing a reciprocative action of one by member opposite to that of the other upon a movement of either leg member.

10 Claims, 3 Drawing Sheets

STRIDING EXERCISER

RELATED U.S. APPLICATION

This application is a continuation-in-part of U.S. patent application Ser. No. 093,778 filed Sept. 8, 1987, now U.S. Pat. No. 4,850,585, for a STRIDING EXERCISER.

BACKGROUND OF THE INVENTION

1. Field

This invention relates to exercise apparatus and more particularly to machines for performing striding-type exercises.

2. State of the Art

A wide variety of exercise machines are known and have been in use for many years. Exercise cycles or stationary exercise bikes, treadmills, multi-purpose gyms, and rowers are typical types of exercise devices which are well known and widely in use. Striding or walking exercises have recently become more popular and more accepted as a desired form of exercise. Therefore, specific machines for performing walking or striding exercises are desirable.

SUMMARY OF THE INVENTION

A striding machine includes support structure for positioning the machine on a support surface. It has a left side and a right side each with journal means adapted thereto and leg means rotably adapted and suspended from the journal means. The journal means are spaced apart to accommodate a user therebetween. Bar structure is secured to the left and right journal means and formed to extend around a user standing on the left and right foot support means. Reciprocating means are interconnected between the left leg means and the right leg means to cause one to rotate opposite to the other upon movement of either.

The reciprocating means includes a left spool means and a right spool means associated at respective left and right journal means. A cable means is trained around the left and right spool means and along the bar structure to cause reciprocal rotation of one spool means upon rotation of the other.

In a preferred arrangement, the bar structure includes right and left members which each are secured to respective left and right journal means to extend therefrom in substantial alignment. A cross bar is interconnected between the left and right members desirably proximate their outward ends.

In a desirable configuration, guide means are positioned on both the left and right members proximate apertures which are formed in the left and right members to register with the bar structure which is a hollow cross bar. The cable means is trained around the guide means and through the hollow cross bar. The guide means are most preferably pulleys with mounting means for adapting the pulleys to the left and right members and to adjust the position of each pulley with respect to the left and right members to in turn adjust the tension of the cable means. The cross member is preferably made of a rigid metal shaped and dimensioned to substantially prevent relative movement between the left side and the right side with the user exercising on the striding machine. The cable may be an unending cable wound around the left and right spools with bights trained around each of the pulleys.

In a preferred arrangement the support means includes a first U-shaped member and a second U-shaped member angularly spaced from the other. Each U-shaped member has left and right upright members secured to the left and right journal means respectively. Desirably the first and second U-shaped members, are adapted to the journal means for relative movement therebetween so that the U-shaped members may be placed proximate each other for storage.

In a highly preferred embodiment, handle means may be connected to the left and right journal means and preferably to the upper ends of the left and right leg means for grasping by the user positioned on the left and right foot support means. The handles are each removeably secured and rotate with their respective leg members. Desirably the left and right leg members each have means for adjusting the length thereof.

In yet another alternate embodiment, the reciprocating means of the striding machine may include a spool arrangement and a rotating shaft extending through the cross bar where the shaft is interconnected with the left and right spools.

BRIEF DESCRIPTION OF THE DRAWINGS

In the drawings, which illustrate the best modes presently contemplated for carrying out the instant invention.

DETAILED DESCRIPTION OF THE DRAWINGS

Figure 1:
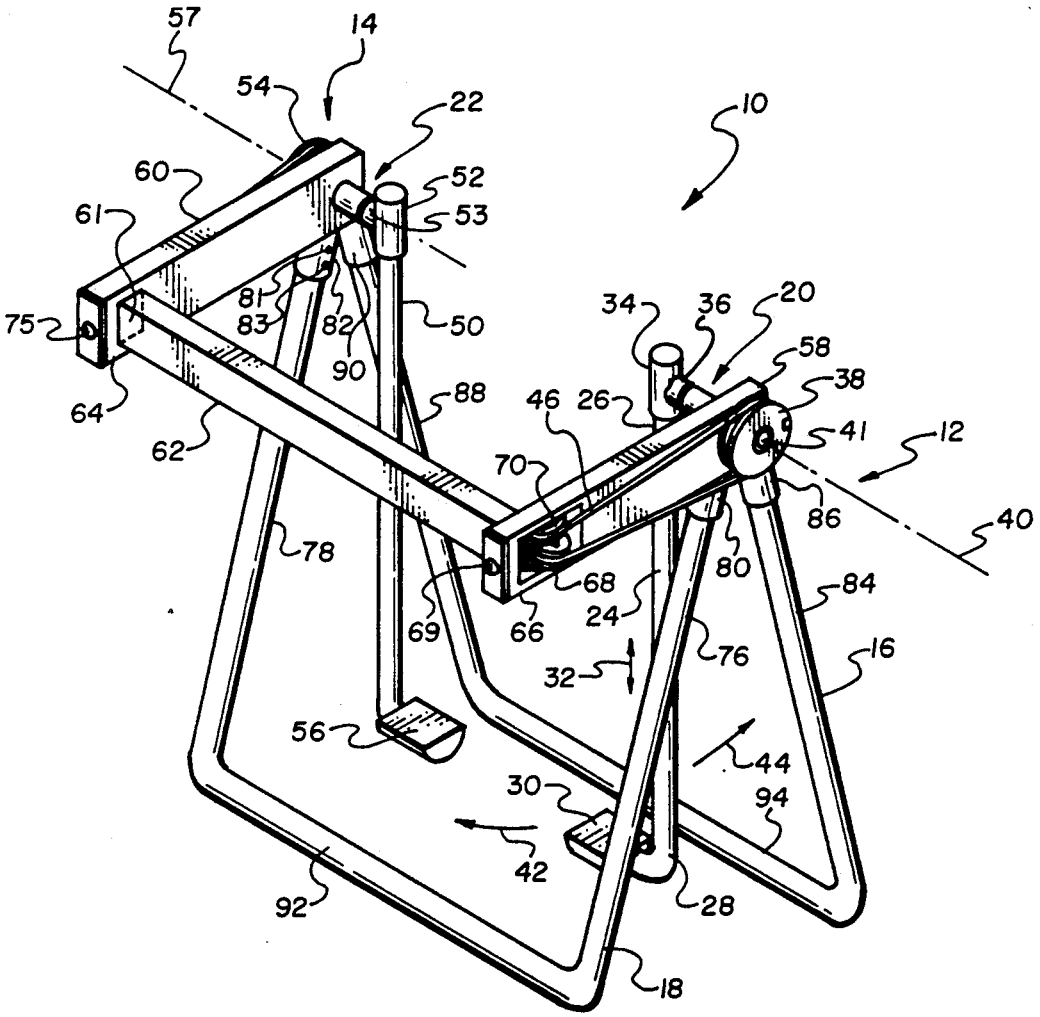
FIG. 1 is a perspective view of the striding exerciser of the instant invention.

A striding exerciser 10 has support structure with a left side 12 and a right side 14. The support structure is here illustrated to be comprised of a first U-shaped member 16 and a second U-shaped member 18 as more fully discussed hereinafter.

The striding exerciser 10 of FIG. 1 includes left journal means 20 and right journal means 22. The journal means 20 and 22 may be a tubular journal as here shown or any other convenient or desired structure to rotatably support an axel or shaft. A left leg means such as leg 24 has a journal end 26 which is adapted to the left journal means 20 rotate thereabout. The leg 24 also has a foot end 28 with foot support means 30 secured thereto to support a substantially upright user. The foot support means 30 is spaced from the journal end 26 a distance 32 substantially the same as the distance between the foot and hip of a user.

As illustrated in FIG. 1, left leg 24 is secured to a sleeve 34 preferably by welding. The sleeve 34 has a base 36 adapted to a shaft to rotate therewith. The shaft extends through the journal 20 for further interconnection to a left spool 38 which is keyed to the shaft 40. Therefore upon movement of the leg 24 in a forward 42 or rearward 44 direction in an arc about the axis 40, the axle 41 and, in turn, the spool 38 rotates to cause movement of the cable 46 as more fully discussed hereinafter.

The striding exerciser 10 or FIG. 1 also has a right leg 50 which is also preferably connected to its sleeve 52 by welding. The sleeve 52 is also adapted to a base 53 which is secured to an axle to rotate therewith and to simultaneously rotate a spool 54 mounted or keyed to the shaft in the same fashion as the left side 12. Of course the shaft extends through the journal 22.

Bar structure is provided to stabilize the left and right sides 12, 14 and prevent or inhibit relative movement therebetween. That is, with a user mounted on the foot support means 30 of the left leg 24 and the foot support means 56 of the right leg 50, and further upon movement of the foot support means 30 and 56 with the legs by the user, it can be seen that a torque or twisting force will be applied to the support structure such as the U-shaped members 16 and 18. At rest, the axis 40 and the axis 57 are in alignment or coaxial. The torque may cause misalignment of the axis 40 and axis 57 causing the user to feel movement in the structure and causing undesired stress and wear of components. Thus the bar structure is selected to be of sufficient rigidity to inhibit relative movement between the left side 12 and the right side 14 and minimize misalignment of the axis 40 with axis 57. The bar structure is thus secured to the left 20 and right 22 journal means. The bar structure is shaped to extend around a user positioned substantially upright on the foot support means 30, 57.

As shown in FIG. 1, the bar structure preferably consists of a left member 58 and a right member 60 which are each adapted to their respective journal means 20 and 22. The left 58 and right 60 members extend outwardly from the journal means 20 and 22 and are in substantial alignment as shown. A cross bar 62 is interconnected to the left 58 and right 60 members proximate their outward ends 64 and 66.

Guide means are adapted to the members 58 and 60 to guide the cable 46 thereabout. In FIG. 1, the guide means are shown to be left pulleys 68 and 70 on the left side 12 and pulleys 72 and 74 (FIG. 2) on the right side 14. The cross bar 62 is preferably a hollow metal member and secured to the members 58 and 60 by any means which provides for secure and durable attachment. In the illustrated embodiment, welding has been found to be suitable since the members 58 and 60 are also formed of a metal material preferably a readily available cast aluminum. Apertures 61 are formed in the members 58 and 60 to register with the hollow cross member 62. Thus the cable 46 may be threaded through the cross member 62 from the left side 12 to the right side 14 for further passage about the pulleys 68 and 70 and 72 and 74 and further passage about the respective spools 38 and 54.

The support means of the striding exerciser may be any convenient structure to support the machine on a support surface. As here illustrated a front 18 and rear 16 U-shaped leg structure has been selected. The front U-shaped structure 18 includes a left upright support 76 and right upright support 78 each connected to its respective sleeve 80 and 82 which are further adapted to their respective journal means 20 and 22. In FIG. 1, the sleeves 80 and 82 are welded to members 58 and 60. The upright supports 76 and 78 are connected to their respective sleeves 80 and 82 by set screws such as screws 81 and 83 shown for the right upright support 78. The rear leg 16 similarly has a left upright member 84 connected by set screws to a sleeve 86 and a right upright member 88 connected by set screws to sleeve 90. Sleeves 86 and 90 are respectively secured by welding to the left and right members 58 and 60. The U-shaped members 16 and 18 also have floor members 92 and 94 respectively all for the purpose of providing solid support for the entire machine 10 on a support surface selected by the user.

Figure 2:
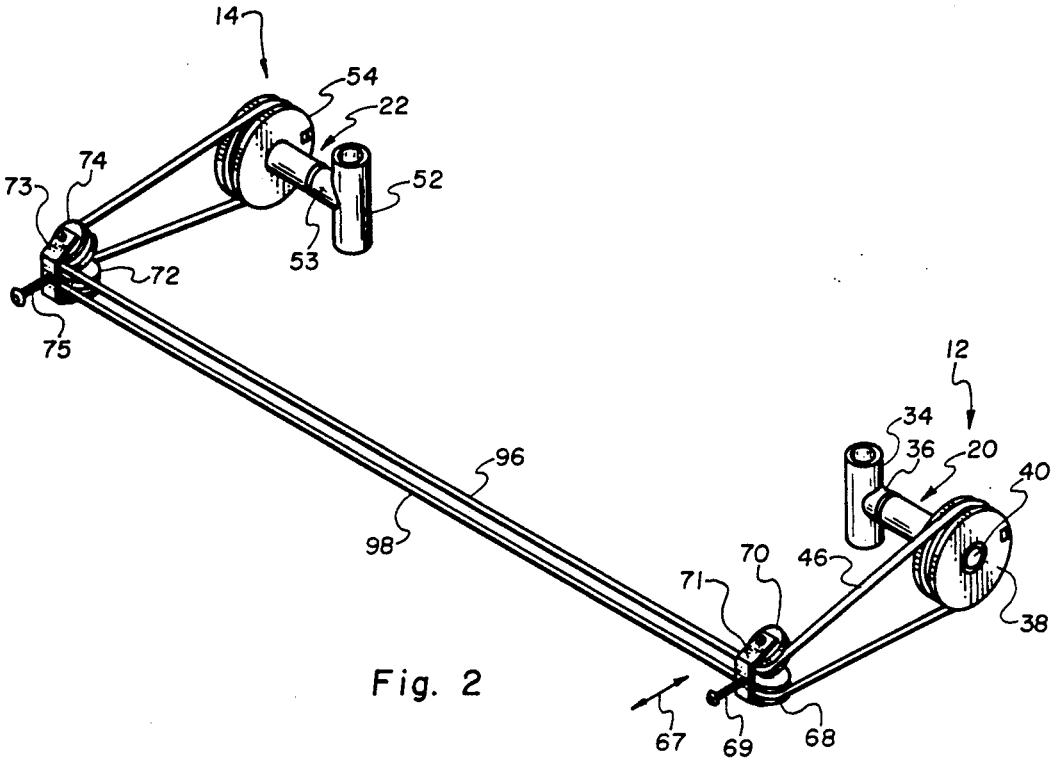
FIG. 2 is a perspective arrangement of the spools and cable of the embodiment of FIG. 1.

Referring specifically to FIG. 2, the reciprocating means adapted for use in the structure of FIG. 1 is more clearly illustrated. The cable 46 leads from the left spool 38 to a first bight 96 which is trained around pulley 70 and pulley 74. The cable 46 is then further trained around the right spool 54 to lead to the second bight 98 which is trained about pulley 72 and pulley 68 and, in turn, about spool 38. The cable 46 is connected about the respective spools 38 and 54 with sufficient friction to preclude slippage so that rotation of spool 38 causes spool 54 to rotate a corresponding amount. Thus, rotation of the sleeves 34 and 52 by the user by operation of the legs 24 and 50, cause reciprocal rotation of the spools 38 and 54 through movement of the cable 46 and more particularly the first bight 96 and the second bight 98. The reciprocating motion is therefore transmitted from one leg to the other by the cable 46 and, in turn, between the foot means 30 and 56 so the user will operate or move the user's legs in a striding back and forth motion.

Figure 3:
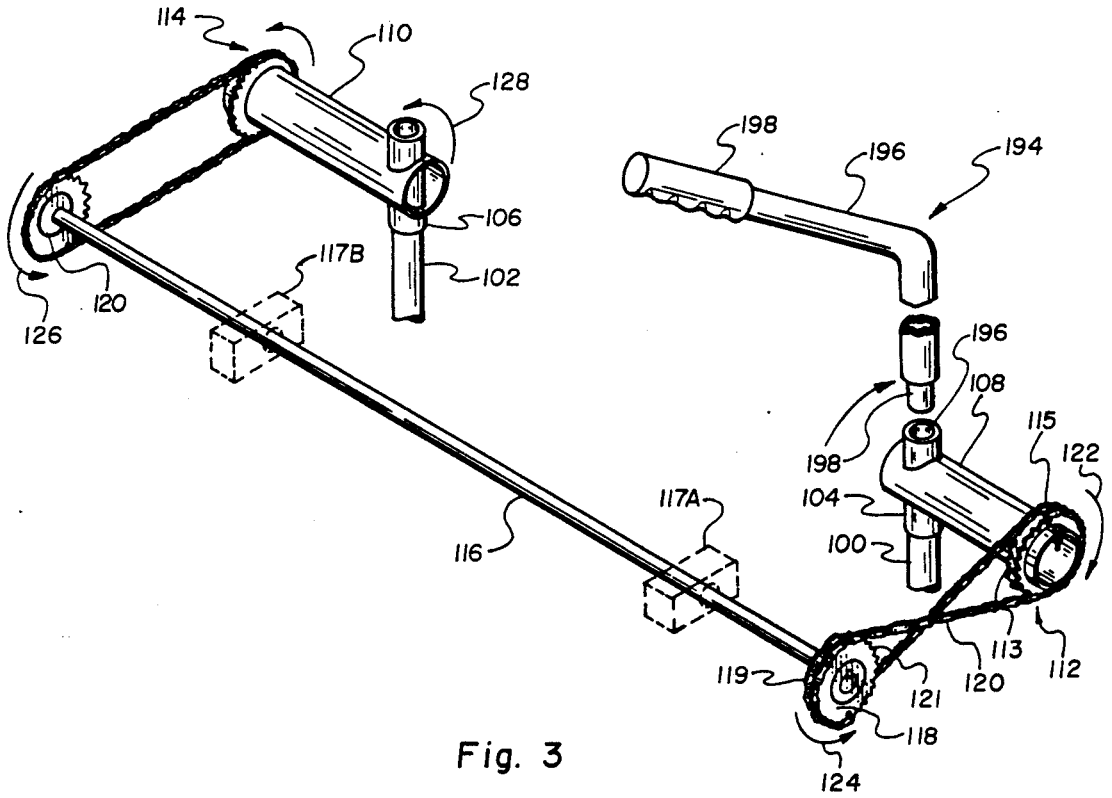
FIG. 3 is an alternate arrangement of reciprocating structure for use with a strider of the instant invention.

FIG. 3 illustrates an alternate reciprocating structure in which the left leg 100 and the right leg 102 each are secured to corresponding sleeves 104 and 106. As here shown the sleeves 104 and 106 pass through and are secured to corresponding shafts 108 and 110. The shafts are mounted in journals which are not here illustrated for clarity. The spools on the end of each shaft are here shown to be sprockets 112 and 114. Upon rotation of the legs 100 and 102, it can be seen that corresponding rotation is imparted to the sprockets 112 and 114.

The reciprocating means shown in FIG. 3 includes a shaft 116 which extends through and is journaled to rotate in a cross-bar such as cross-bar 62 of the structure of FIG. 1. Nylon or teflon bushings or bearings 117A and 117B shown in phantom may be mounted in the cross bar to provide rotational support for the shaft 116. At the opposite ends of the shaft 116, sprockets 118 and 120 are secured. A link chain 120 interconnects sprocket 112 and 118. The left side link chain 120 crosses to reverse the direction of rotation. That is, rotation of the sprocket 112 in a clockwise direction 122 causes the sprocket 118 to rotate in a counter-clockwise direction 124. As a result, the shaft 116 rotates in a counter-clockwise direction imposing counter-clockwise movement 126 on its right sprocket 120 and also on the right sprocket 114 to, in turn, cause counter or reciprocal movement 128 to the leg 102 of substantially the same arc or degree of movement as that traveled by leg 100 on the left side. It may be noted that the sprocket 112 has two sets of spaced apart teeth 113 and 115 of substantially the same diameter. The sprocket 118 on the left end of the shaft 116 also has two sets of spaced apart teeth 119 and 121 of substantially the same diameter. One set of teeth act as a take-up and the other as a let-off so that the chain 120 does not rub against itself at the cross over point.

In FIG. 3, handle structure 194 is shown attached to the sleeve 134. Another handle (not shown) may be attached to sleeve 144. Threads may be formed in the interior 196 of the sleeve 134 so that female threads 198 corresponding therewith formed on the handle structure 194 may be threaded into sleeve 134. The handle structure 194 is angulated to have an upper section 196 with a handle 198 for grasping by the user.

Figure 4:
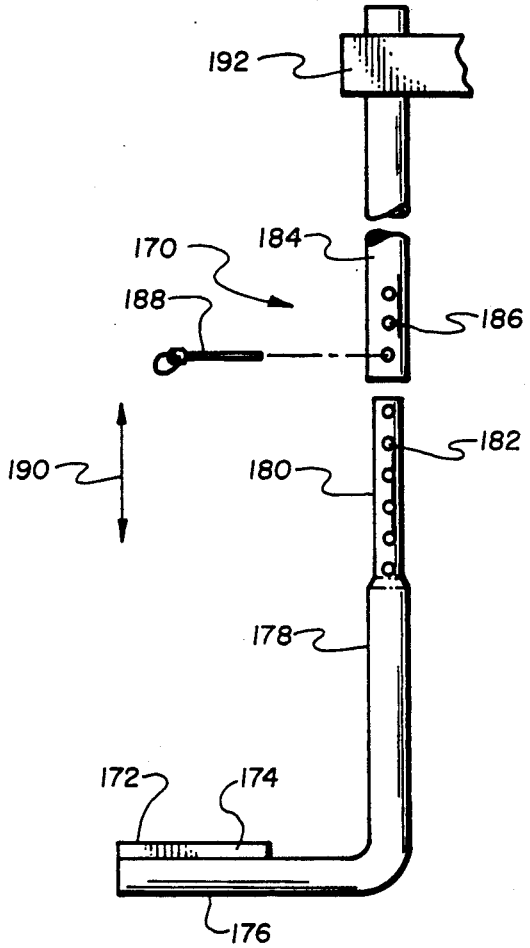
FIG. 4 illustrates the leg member for use with the instant invention.

FIG. 4 shows a leg 170 adapted to an axle 192. The foot support means 172 is pedal made or a non slip material such as rubber. The pedal 172 is supported by tube structure 176 which extends unitarily up into the lower leg structure 178. As shown, the lower leg structure 178 has a narrow section 180 formed with a plurality of holes 182 which pass through. The upper section 184 of the leg 170 has corresponding series of apertures 186 which are sized to register with selected of the apertures 172 so that a pin 188 may be inserted therethrough to secure the lower section 178 to the upper section 184. As a result, the user may adjust the length 190 of the leg 170 so that the foot will be supported on the foot support means 172 with the hips of the user proximate the shaft 192 and in turn in general alignment to rotate about the shaft axis such as axis 40 and 57 (FIG. 1).

Figure 5:
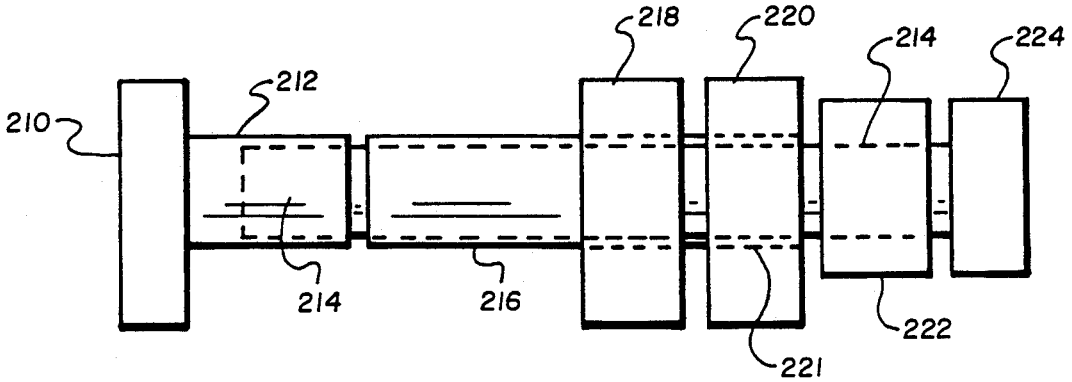
FIG. 5 is an alternate journal arrangement for use with the strider of the instant invention.

Referring to FIG. 5, a sleeve 210 is connected to a base 212, which in turn, is secured to a shaft 214 to rotate therewith. The shaft 214 passes through and rotates in a journal 216. A first leg sleeve 218 is secured to the journal 216 and has the shaft 214 extending through an aperture formed therein.

A second leg sleeve 220 has an aperture 221 formed therein to receive the shaft 214 and to freely rotate thereabout. The shaft 214 also extends through an extension member 222 which is similar to extension member 58 of FIG. 1. The spool 224 is secured to the end of the shaft 214 to rotate therewith. Since the second sleeve 220 is free to rotate about the shaft 214, it rotates relative to sleeve 218. Thus, legs or upright supports such as upright supports 76, 78, 84, 88 (FIG. 1) can be arranged to move relative to each other. That is, U-shaped supports such as supports 16 and 18 in FIG. 1 can rotate through an arc between a storage position in which the support 16 is proximate the support 18 and an extended position such as that shown in FIG. 1.

Referring back to FIG. 1, it can be seen in operation the user places his right foot on the foot support means 56 and his left foot on the foot support means 30. The user may then move either foot, which, in turn, causes the other to move in the opposite direction. The user may place his hand on the left and right members 58 and 60 respectively or the cross bar 62 for support while mounting and to provide support in the event the user may lose his balance in the course of exercising. Similarly handles may be provided similar to handle 194 of FIG. 4 for the user to grasp for stability and also to exercise the upper body.

It is to be understood that the embodiments of the invention above-described are merely illustrative of the application of the principles of the invention. Reference herein to details of the illustrated embodiment is not intended to limit the scope of the claims which themselves recite those features regarded as essential to the invention.

What is claimed is:

1. A striding machine comprising:

support structure for positioning on a support surface, said support structure having a left side and a right side spaced apart from each other a distance selected to accommodate a user therebetween;

left journal means secured to said support structure at said left side;

right journal means secured to said support structure at said right side;

left leg means having a journal end rotatably secured to said left journal means to rotate thereabout and a foot end with foot support means secured thereto to support a substantially upright user and spaced from said journal at a distance substantially the same as the distance between the foot and hip of a user;

right leg means having a journal end rotatably secured to said right journal means to rotate thereabout and a foot end with foot support means secured thereto to support a substantially upright user and spaced from said journal at a distance substantially the same as the distance between the foot and hip of a user;

bar structure having a left end secured to said left journal means and a right end secured to said right journal means to stabilize said left side and said right side and inhibit relative movement therebetween with a user selectively operating said left leg means and said right leg means, said bar structure being shaped to extend around a user positioned substantially upright on said foot support means, said bar structure having a channel formed therein;

reciprocating means interconnecting said left leg means with said right leg means to cause one to rotate opposite to the other upon movement of either, said reciprocating means including left spool means connected to rotate with said left leg means, right spool means connected to rotate with said right leg means, and cable means trained about said left and right spool means and along said bar structure in said channel to cause rotation of one spool means upon rotation of the other.

2. A striding machine comprising:

support structure for positioning on a support surface, said support structure having a left side and a right side spaced apart from each other a distance selected to accommodate a user therebetween;

left journal means secured to said support structure at said left side;

right journal means secured to said support structure at said right side;

left leg means having a journal end rotatably secured to said left journal means to rotate thereabout and a foot end with foot support means secured thereto to support a substantially upright user and spaced from said journal at a distance substantially the same as the distance between the foot and hip of a user;

right leg means having a journal end rotatably secured to said right journal means to rotate thereabout and a foot end with foot support means secured thereto to support a substantially upright user and spaced from said journal at a distance substantially the same as the distance between the foot and hip of a user;

bar structure having a left end secured to said left journal means and a right end secured to said right journal means to stabilize said left side and said right side and inhibit relative movement therebetween with a user selectively operating said left leg means and said right leg means, said bar structure being shaped to extend around a user positioned substantially upright on said foot support means, said bar structure including a right member secured to said right journal means to extend away therefrom, a left member secured to said left journal means to extend away therefrom in substantial alignment with said right member, a cross bar interconnected between said left member and said right member, said cross bar being hollow and apertures being formed in said left and right members to register with the hollow cross bar;

reciprocating means interconnecting said left leg means with said right leg means to cause one to rotate opposite to the other upon movement of either, said reciprocating means including left spool means connected to rotate with said left leg means, right spool means connected to rotate with said right leg means, and cable means trained about said left and right spool means and through said apertures and said hollow cross bar to cause rotation of one spool means upon rotation of the other; and guide means positioned on both said left member and said right member to guide said cable means.

3. The striding machine of claim 2 wherein said guides are pulleys and wherein said pulleys include mounting means to adjust the position of each pulley with respect to the said left and right members to adjustably tension said cable means.

4. The striding machine of claim 3 wherein guides are each a pair of pulleys and wherein said cable is an unending cable wound around the said left spool and said right spool with a bights trained around each of said pulleys.

5. The striding machine of claim 1 wherein said support means includes a first U-shaped member and a second U-shaped member angularly spaced from said first U-shaped member each having a left and right upright member secured to the left and right journal means respectively.

6. The striding machine of claim 5 wherein one of said first and second U-shaped members are secured to said journal means for relative movement of said first U-shaped member with respect to said second U-shaped member between a first position in which said first and second U-shaped members are rotated apart with respect to each other to support the striding machine on a surface and a second position in which the first and second U-shaped members are positioned proximate each other for storage.

7. The striding machine of claim 6 further including left handle means connected to said left journal means and right handle means connected to said right journal means, each of aid handle means extending uprightly and away from said journal means and sized for grasping by the arms of a user in striding position.

8. The striding machine of claim 7 wherein said left and right handle means are each removably secured to said journal means to rotate with its respective leg members.

9. The striding machine of claim 8 wherein said left and right leg members each have adjustment means to adjust the length thereof.

10. The striding machine of claim 3 wherein said left member and right member and said cross member are all formed of metal and shaped and dimensioned to be rigid to substantially prevent relative movement between said left side and said right side with a user exercising on the striding machine.

* * * * *